US006559878B2

(12) United States Patent
McIlvaine et al.

(10) Patent No.: US 6,559,878 B2
(45) Date of Patent: May 6, 2003

(54) SYSTEM AND METHOD FOR FUSING TONER

(75) Inventors: George V. McIlvaine, Boise, ID (US); Laurent A. Regimbal, Eagle, ID (US); David K. Towner, Boise, ID (US)

(73) Assignee: Hewlett-Packard Development Co., L.P., Houston, TX (US)

( * ) Notice: Subject to any disclaimer, the term of this patent is extended or adjusted under 35 U.S.C. 154(b) by 0 days.

(21) Appl. No.: 09/747,049

(22) Filed: Dec. 20, 2000

(65) Prior Publication Data

US 2002/0075376 A1 Jun. 20, 2002

(51) Int. Cl.[7] ..... B41J 2/435; B41J 2/385
(52) U.S. Cl. ..... 347/228; 347/156
(58) Field of Search ..... 347/115, 124, 347/156, 225, 240, 251, 252, 253, 228; 399/136

(56) References Cited

U.S. PATENT DOCUMENTS

| | | | | | |
|---|---|---|---|---|---|
| 5,245,393 | A | | 9/1993 | Storlie et al. | 399/322 |
| 5,296,877 | A | * | 3/1994 | Sato | 347/115 |
| 5,459,561 | A | | 10/1995 | Ingram | 399/336 |
| 5,666,598 | A | * | 9/1997 | Sugita et al. | 399/136 |

FOREIGN PATENT DOCUMENTS

| | | | | |
|---|---|---|---|---|
| JP | 59-95576 | * | 1/1984 | G03G/15/20 |
| JP | 7-325493 | * | 12/1995 | G03G/15/20 |

* cited by examiner

*Primary Examiner*—Hai Pham

(57) ABSTRACT

An apparatus and method are provided for fusing toner to a print medium. According to one embodiment, the apparatus includes a laser source optically coupled to a predefined position in a print medium pathway. A laser beam generated by the laser source is directed to fall upon the print medium shuttled along the print medium pathway. Finally, a laser controller is coupled to the laser source to control the laser beam to generate a predefined fusing exposure of the laser beam on the print medium.

47 Claims, 4 Drawing Sheets

SYSTEM AND METHOD FOR FUSING TONER

TECHNICAL FIELD

The present invention is generally related to the field of printing and, more particularly, is related to a system and method for fusing toner in a laser printing device.

BACKGROUND OF THE INVENTION

In conventional laser printers, the fusing of toner onto paper is generally accomplished by applying heat to the toner and the paper with an external heat source. This external heat source usually includes one or more rollers that are heated to the fusing temperature. The rollers may be heated, for example, by placing long, thin, high-wattage incandescent lamps inside the rollers to which a proper power source is applied. The radiant energy from the incandescent lamps heats the rollers from the inside to the fusing temperature. Toner is fused to paper by running the paper between the heated rollers accordingly. Another approach employed to fuse toner to paper is to apply a high-intensity flash lamp to the toner/paper to perform so called "flash fusing".

There are disadvantages to the conventional toner fusing approaches outlined above. For example, conventional fusing apparatus require complicated heat management strategies that result in sophisticated mechanical, thermal and electrical design that is relatively expensive. Such fusers are large, heavy, slow to reach operating temperature, and are inefficient users of energy. The heat that is generated by such fusers is generally transferred to many areas inside a printer where heat is undesirable. Consequently, materials selected for use in the design of laser printers using conventional fusers is highly constrained by heat considerations. The actual fusing temperature achieved by conventional fusers varies widely due to inherent difficulty of sensing and rapidly adjusting fuser temperature with available control systems. Improper fusing temperature and the spatial and temporal variation of fusing temperature cause a variety of print quality defects. Conventional fusers are also responsible for a large fraction of the media damage, jams, and damaged printers experienced by printer users.

SUMMARY OF THE INVENTION

In light of the foregoing, the present invention provides for an apparatus and method for fusing toner to a print medium. In one embodiment, the apparatus includes a laser source optically coupled to a predefined position in a print medium pathway. A laser beam generated by the laser source is directed to fall upon the print medium shuttled along the print medium pathway. Finally, a laser controller is coupled to the laser source to control the laser beam to generate a predefined fusing exposure of the print medium by the laser beam.

In addition, the present invention also encompasses a method for fusing toner to a print medium. The present method comprises the steps of: generating a laser beam, coupling the laser beam to a predefined position in a print medium pathway, wherein the laser beam is directed to fall upon the print medium shuttled along the print medium pathway, and, controlling the laser beam to generate a predefined fusing exposure at the predefined position to fuse an amount of toner to the print medium.

A number of advantages are realized by fusing toner to a print medium according to the present invention.

Specifically, the complicated heat management strategies associated with conventional fusing systems are not required in the present invention as there are no heated rollers for toner fusing. The fusing apparatus according to the present invention can be relatively small, lightweight and efficient as compared with the conventional fusing systems and requires no fuser warm up time before use. Because heat generation is minimized in the present invention, materials selected for use in the design of laser printers can be less constrained by heat considerations. Also, control of fusing temperatures is not as great a concern and a large fraction of print media damage and jams may be alleviated. In addition, the present invention provides for the selective fusing of print media, where areas without toner to fuse are not subjected to fusing energy as in conventional fusers. In addition, print media of greatly varying thicknesses may be fed through a laser printer or other device that employs a toner fusing apparatus according to the present invention. Specifically, it is not necessary to heat the full thickness of the print media itself for proper fusing according to the present invention, thereby allowing the use of print media with greater thickness as compared with print media used in conventional fusing systems.

Other features and advantages of the present invention will become apparent to a person with ordinary skill in the art in view of the following drawings and detailed description. It is intended that all such additional features and advantages be included herein within the scope of the present invention.

BRIEF DESCRIPTION OF THE DRAWINGS

The invention can be understood with reference to the following drawings. The components in the drawings are not necessarily to scale. Also, in the drawings, like reference numerals designate corresponding parts throughout the several views.

DETAILED DESCRIPTION OF THE INVENTION

Figure 1:
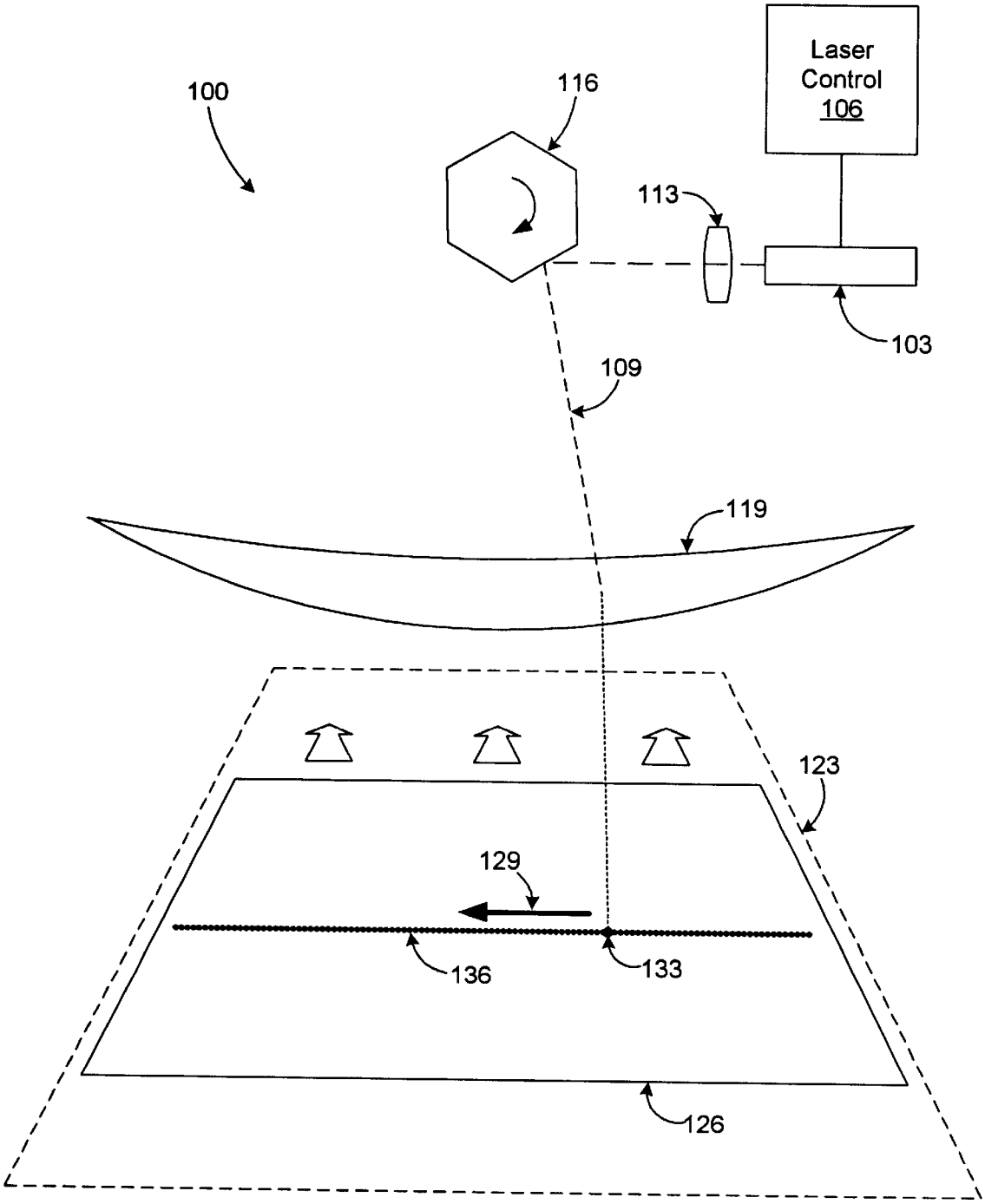
FIG. 1 is a block diagram of a toner fusing apparatus according to an embodiment of the present invention.

With reference to FIG. 1, shown is a toner fusing system 100 according to an embodiment of the present invention. The toner fusing system 100 may be employed within a printer, facsimile machine, copier or other printing device or system to fuse toner onto a print medium. The toner fusing system 100 is employed to fuse toner onto a print medium such as, for example, paper, transparencies, or other print medium.

Before a detailed discussion of the toner fusing system 100 is offered, first a discussion of the general functionality of a printer, for example, that employs the toner fusing system 100 is given to provide context within which to understand the operation of the toner fusing system 100. To begin, a printer may include a pickup mechanism, for example, that grabs a print medium such as paper and employs various rollers and other devices to guide the paper along a print medium pathway. At the same time, an imaging laser is employed to generate an image on a cylindrical drum coated with a photoconductor material. The photoconductor material is first charged to a uniform charge density, then illuminated by the imaging laser. The areas on the drum that are exposed by the imaging laser become conductive and establish a different charge density after exposure than the unexposed areas. The exposed areas on the drum generally correspond to dots or pixels that together make up the image to be created. The photoconductor drum is then developed by exposing it to an amount of electrostatically charged toner and toner particles electrostatically adhere to areas of the drum having altered charge density due to exposure by the imaging laser. In effect, an electrostatic image is created on the drum and toner adheres to the image.

The drum then comes into contact with the print medium as it progresses along the print medium pathway. During this contact, the toner is transferred electrostatically from the drum onto the print medium, thereby transferring the image to the print medium. The print medium is then fed through the toner fusing system 100. The toner fusing system 100 causes the toner to be melted and fused to the print medium in a permanent manner. Thus, the toner fusing system 100 lies along the print medium pathway of the printing device.

With this in mind, reference is made to FIG. 1, that shows the basic components of the toner fusing system 100 that includes a fusing laser 103 and a laser control 106. The fusing laser 103 generates a laser beam 109 that is directed through beam-shaping optics 113 to a spinning polygonal mirror 116. The spinning polygonal mirror 116 directs the laser beam 109 to speed linearizing and beam-shaping optics 119 that further direct the laser beam 109 to predetermined locations on a print medium pathway 123. Specifically, the laser beam 109 is directed to fall upon specific spots 133 of the print medium 126 as it is shuttled along the print medium pathway 123.

Generally, the position of each of the spots 133 is located so as to strike the print medium 126 selectively at points that have a dot 136 of unfused toner. The spots 133 may be larger, smaller, or equal in size, for example, to the dots 136, depending upon the resolution of the image to be created as well as the focusing of the laser beam 109. Alternatively, the laser beam 109 may represent a number of laser beams that are generated in parallel by a number of fusing lasers, where each of the lasers is controlled in a similar manner to the fusing laser 103 so that spots may be exposed to laser energy multiple times. Also, multiple laser beams may be generated in a manner so that multiple spots 133 may be exposed to laser energy at the same time.

Thus, the beam-shaping optics 113, the spinning polygonal mirror 116, and the linearizing and beam-shaping optics 119 serve to optically couple the laser beam 109 from the fusing laser 103 to the predetermined spots 133 on the print medium pathway 123. In this manner, the laser beam 109 falls incident to the print medium 126 as it progresses along the print medium pathway 123. The spinning polygonal mirror 116 causes the laser beam 109 to strike the print medium 126 in continuous scanning motion 129. Note, however, that the optical coupling configuration shown in FIG. 1 merely provides an example framework within which to understand the optical coupling of the laser beam 109 to the predetermined spots 133 on the print medium pathway 123. Those with ordinary skill in the art can appreciate that other optical configurations may be employed that use additional or fewer optical components. These optical components may include, for example, mirrors and lenses, etc.

Next, a discussion of the operation of the toner fusing system 100 is offered. First, the laser control 106 causes the fusing laser 103 to generate the laser beam 109. The laser control 106 thus controls whether the fusing laser 103 is in an "on" state or an "off" state as well as controlling its output power when in the "on" state. The laser beam 109 then propagates from the fusing laser 103 through the beam-shaping optics 113 to the spinning polygonal mirror 116. The laser beam 109 is deflected by the spinning polygonal mirror 116 toward the speed linearizing and beam-shaping optics 119 and onto the print medium 126 in repetitive scans as the print medium 126 is shuttled along the print medium pathway 123. By manipulating the laser control 106 in coordination with both the movement of the spinning polygonal mirror 116 and the movement of the print medium 126 along the print medium pathway 123, the laser beam 109 may be directed to selectively expose a number of dots 136 on the print medium 126.

The beam-shaping optics 113, spinning polygonal mirror 116, and the speed linearizing and beam-shaping optics 119 are all optical components that are employed to define a scanning optical pathway between the fusing laser 103 and the print medium 126 as it progresses down the print medium pathway 123. Thus, the optical components may include, for example, optical beam-shaping components such as lenses, optical beam reflecting components such as mirrors, or filters, etc. The scanning optical pathway is created by a particular arrangement of the optical components as shown. However, it is understood that other arrangements of various optical components may be employed to achieve a desired scanning optical pathway by which the laser beam 109 may be directed to the print medium in a manner to fuse toner as discussed herein.

The spots 133 that define the positions on the print medium 126 exposed to the laser beam 109 are positioned over the dots 136 of unfused toner on the print medium 126. Thus, a particular spot 133 denotes the area of the laser beam 109 incident on the print medium 126. The dots 136 are the areas upon which the toner is deposited onto the print medium 126. In general, the size of the dots 136 depends upon the resolution of the image on the print medium 126. For example, the size of the dots 136 may correspond to the size of the pixels that make up the image to be created. The size of the spots 133 may be the same size as the dots 136, or may be larger or smaller than the dots 136 as will be described.

When the laser beam 109 falls onto the unfused toner, the unfused toner is melted and permanently adheres to the print medium 126. The amount of energy transferred to the unfused toner and the nature of the transfer that causes the desired melting is referred to herein as the "fusing exposure." The fusing exposure depends, for example, upon the power of the laser beam 109 and the pulse width or period of time the laser beam 109 is focused on a particular spot 133.

As the spinning polygonal mirror 116 rotates, the laser beam 109 is continually cycled in a scanning motion 129 across the print medium 126 as shown until the entire image is fused to the print medium 126. In processing the entire print medium 126, the toner fusing system 100 allows for selective fusing in that the laser energy is applied to the dots 136 that include the toner while avoiding those dots 136 that do not have toner. As an alternative to the above discussion, it may be desirable to employ multiple fusing lasers 103 that generate multiple laser beams 109 that work in parallel to fuse the unfused toner to the print medium 126. In particular, the multiple laser beams 109 may scan one row of dots 136 multiple times, thereby exposing the spots 133 multiple times. Alternatively, each laser beam 109 may be directed to spots 133 along a separate scan line, where multiple rows of dots 136 are fused at the same time.

The motion of the spinning polygonal mirror 116 and the print medium 126 result in the repeated scanning motion 129 of the laser beam 109. To accomplish selective exposure of unfused toner on the print medium 126, at appropriate times during a particular scan the fusing laser 103 is turned "on" or "off". Also, the fusing exposure or amount of energy delivered to the respective spots 133 is varied in coordination with the scanning of the laser beam 109 to provide a fusing exposure that accords with the requirements of each of the spots 133. The desired fusing exposure achieved for each spot 133 depends on a number of parameters as discussed below.

A first parameter to consider in determining the fusing exposure for a particular spot 133 is the mass of toner within the spot 133 to be fused. A greater mass of toner requires a fusing exposure with a greater amount of energy delivered to melt the toner. Accordingly, a lesser mass of toner requires a fusing exposure with less energy. Consequently, the fusing laser 103 is controlled by the laser control 106 to generate an appropriate fusing exposure based upon the mass of the toner in a respective spot 133. Ultimately, the nature fusing exposure is determined to melt the mass of toner without substantially affecting the print medium 126. Note, however, that the fusing exposure may vary from the nominal exposure mandated by the mass of the toner to achieve desired effects in the print quality such as gloss as will be discussed.

Once an appropriate fusing exposure has been determined for a given spot 133, then various parameters may be controlled to create the fusing exposure. Among the parameters that may be controlled to generate a given fusing exposure are the pulse width or duration of the laser beam 109 as it falls onto a particular spot 133 and the power or irradiance of the laser 103 focused on the spot 133. The laser control 106 may be manipulated to determine both the pulse width and the power of the fusing laser 103 for a given spot 133.

However, other factors are considered in determining the pulse width and power of the laser beam 109. For example, the speed at which the print medium 126 moves along the print medium pathway 126 should be taken into account. Slower speeds would allow greater pulse widths for a given spot 133, thereby delivering more radiant energy over time. For faster speeds, the opposite is true. The rate at which the print medium 126 is fed through toner fusing system 100 (FIG. 1) can be adjusted in light of the irradiance distribution and area of the spots 133.

Additional parameters to adjust or specify may be, for example, the rotational speed and number of sides of the spinning polygonal mirror 116 (FIG. 1). Specifically, the rotational speed and number of sides of the spinning polygonal mirror 116 are parameters that may be specified to allow the laser beam 109 to strike spots 133 multiple times. The speed at which the print medium 126 progresses may also be adjusted accordingly. This would allow the laser beam 109 to strike the spots 133 having unfused toner 139 multiple times by orchestrating multiple passes for each scan line on the print medium 126.

Another parameter that can be adjusted to cause effective melting of the unfused toner 139 is the chemical makeup and color of the toner itself. The chemical makeup and color of the toner determine, among other factors, the percentage of the radiant energy of the laser beam 109 that is absorbed by the unfused toner. Also, the fusing laser 103 may be chosen to provide radiant energy of specific wavelengths that are more readily absorbed by the unfused toner 139 resulting in more efficient melting.

Thus, in some cases, various trade-offs are to be made to generate an optimum fusing exposure that provides adequate fusing of the unfused toner 139 to the print medium 126. For example, to provide superior heating of the unfused toner 139, the laser beam 109 may be focused to a smaller spot size 133, thereby resulting in greater power per unit area. However, a smaller spot size 133 may require a faster spinning polygonal mirror 116 and more sharply focused beam-shaping optical components. Likewise, the pulse width of the laser 109 as it strikes a particular dot 136 may be decreased or increased in relation to the speed of the print medium 126 in its propagation along the print medium pathway 123.

In addition, the fusing exposure may be controlled so as to achieve a desired gloss in the resulting image. Specifically, an image may include distinct print areas on a particular page that require a different gloss than others. In another example, a whole page may have a single gloss setting for the entire image created. To achieve this variation, each of the dots 136 includes a parameter that specifies a gloss setting. The setting may be used, along with other parameters mentioned previously, to determine the nature of the fusing exposure for the dot 136. For example, a greater gloss may be achieved by transferring a greater amount of energy to the spot 133 that covers the respective dot 136 and vice versa. The pulse width may be adjusted as well. These parameters are adjusted in light of the other parameters such as speed of the print medium 126 along the print medium pathway 123, etc.

Figure 2:
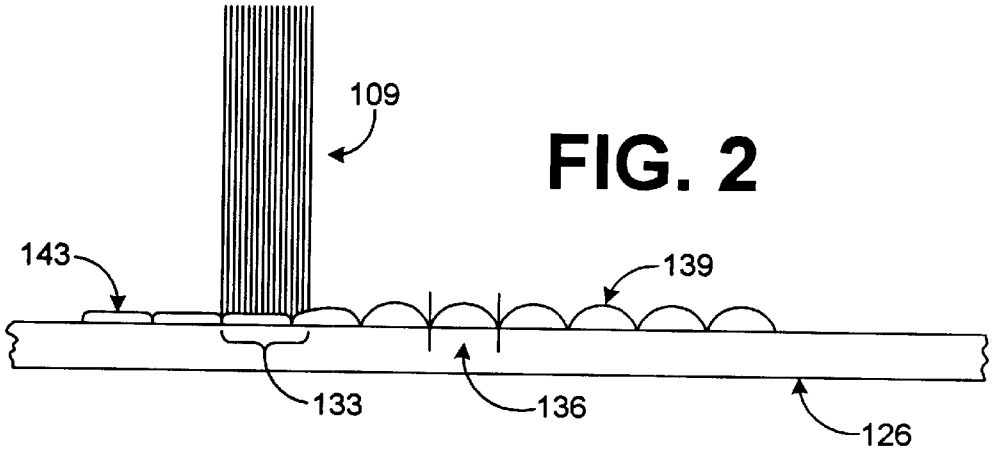
FIG. 2 is a drawing of a laser fusing process employing the toner fusing apparatus of FIG. 1.

With reference to FIG. 2, shown is a portion of the print medium 126 with the laser beam 109 incident on it. A spot 133 is defined as the area within which the laser beam 109 strikes the print medium 126. The print medium 126 includes a number of dots 136 as shown, each dot 136 including an amount of unfused toner 139 deposited thereon. As the laser beam 109 falls on the unfused toner 139, light energy is absorbed by the toner and the toner is melted, thereby resulting in the fused toner 143.

Figure 3A:
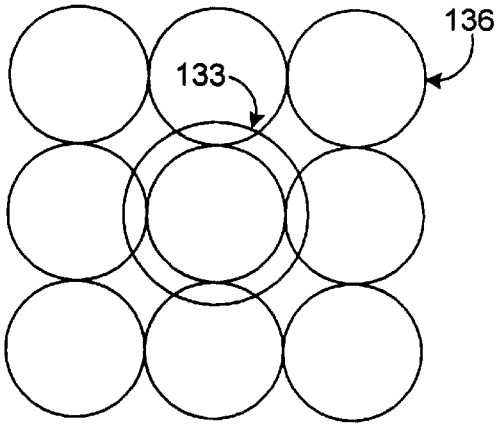
FIG. 3A is a drawing of laser spot overlap achieved using the toner fusing apparatus of FIG. 1.
Figure 3B:
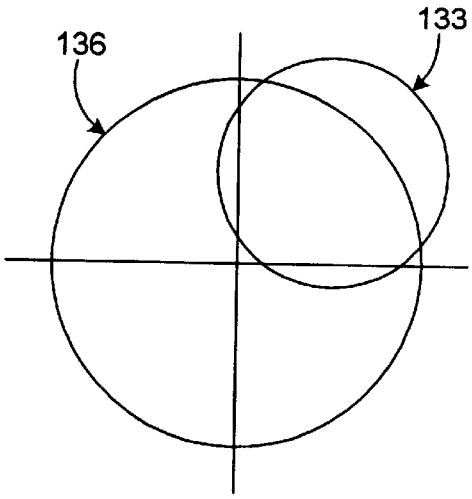
FIG. 3B is a drawing of partial laser spot overlap achieved using the toner fusing apparatus of FIG. 1.

With reference to FIGS. 3*a* and 3*b*, shown are a number of dots 136 and a single spot 133 to display the relative sizes of the dots 136 and the spot 133. Specifically, with reference to FIG. 3*a*, the dots 136 are smaller than the spots 133. The spots 133 overlap the dots 136 to ensure that the entire dot 136 falls within the spot 133 and receives the fusing energy from the laser beam 109 (FIG. 2).

With specific reference to FIG. 3*b*, shown is the opposite situation in which the dot 136 is larger than the spot 133. Assuming that the dot 136 was deposited at a specific scanning rate using an imaging laser as discussed previously, the scanning rate of the fusing laser 103 (FIG. 1) must necessarily be faster to allow the smaller spots 133 to reach the entire area of the larger dots 136. As shown with reference to FIG. 3*b*, the spots 133 should be scanned twice as fast to reach each portion of the dot 136 so as to ensure the entire dot 136 is exposed to the laser beam 109. Although the dots 136 are illustrated as having a circular shape, it is understood that the dots 136 may be created in other shapes as well.

The specific size of the spot 133 relative to the dots 136 provides a parameter that can be adjusted to provide for effective fusing of the unfused toner 139. Such sizes partially determine the irradiance distribution within a focused spot 133, for example, which depends on both the power of the fusing laser 103 and the spot size produced by the beam-shaping optics 113/119. The irradiance within the spots 133 is greater if the power of the laser beam 109 is concentrated into a smaller spot 133. Also, a fusing laser 109 of greater power will generate a focused spot 133 having greater irradiance.

Figure 4:
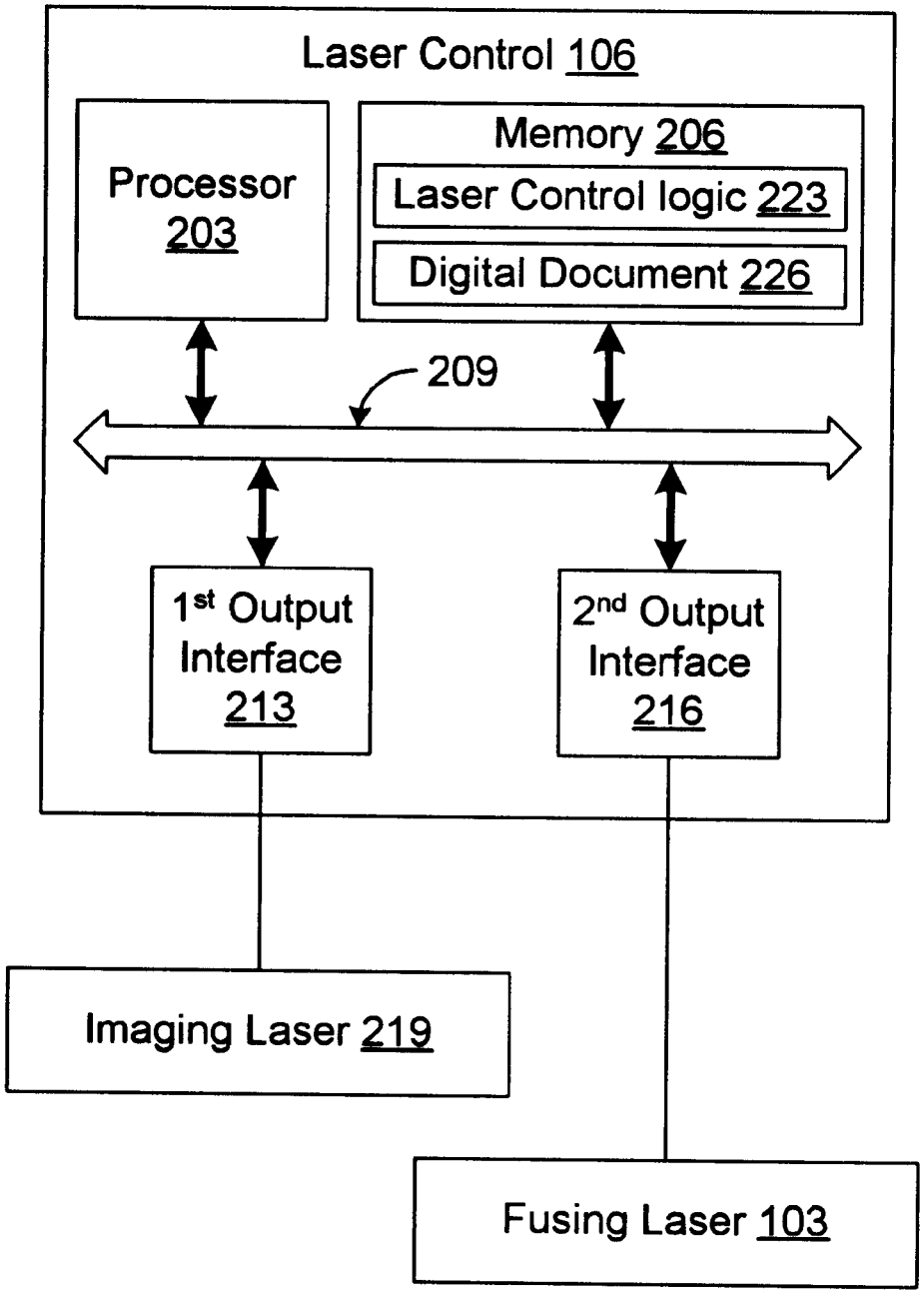
FIG. 4 is a block diagram of a laser control system and a laser employed in the toner fusing apparatus of FIG. 1.

With reference to FIG. 4, shown is the laser control 106 according to another embodiment of the present invention. The laser control 106 includes, for example, a processor 203 and a memory 206, both of which are coupled to a local interface 209. The local interface may be, for example, a data bus with accompanying control bus as is generally known by those with ordinary skill in the art. The laser control 106 also includes first and second output interfaces 213 and 216 that link an imaging laser 219 and the fusing laser 103 to the local interface 209. The first and second output interfaces 213 and 216 include necessary drive circuitry to drive the imaging and fusing lasers 219 and 103 accordingly. The imaging laser 219 is employed to create generate the images on the photoconductive drum as mentioned previously.

The memory 206 may include both volatile and nonvolatile memory components. Volatile components are those that do not retain data values upon loss of power. Nonvolatile components are those that retain data upon a loss of power. Thus, the memory 206 may comprise, for example, random access memory (RAM), read-only memory (ROM), hard disk drives, floppy disks accessed via an associated floppy disk drive, compact disks accessed via a compact disk drive, magnetic tapes accessed via an appropriate tape drive, and/or other memory components, or a combination of any two or more of these memory components.

In addition, the processor 203 may represent multiple processors that operate in parallel and the memory 206 may represent multiple memories that operate in parallel with the multiple processors. In such a case, the local interface 209 may be an appropriate network that facilitates communication between any two of the multiple processors or between any processor and any of the memories, etc. The local interface 209 may facilitate memory-to-memory communication as well. The processor 203, memory 206 and local interface 209 may be electrical or optical in nature. Also, the memory 206 may be magnetic in nature in accordance with the memory devices identified above.

Stored on the memory 206 and executable by the processor 203 is laser control logic 223 and a digital document 226. The laser control logic 223 is executed, for example, to drive the imaging laser 219 and the fusing laser 103 to create a page of the document in the printer. Specifically, the imaging laser 219 is driven to cause the image to be created on the organic photoconductor drum and the fusing laser 103 is employed as shown with reference to FIG. 1 in the toner fusing system 100. The laser control logic 223 performs these tasks to create a hard copy document from the digital document 226 using the printing apparatus.

Figure 5:
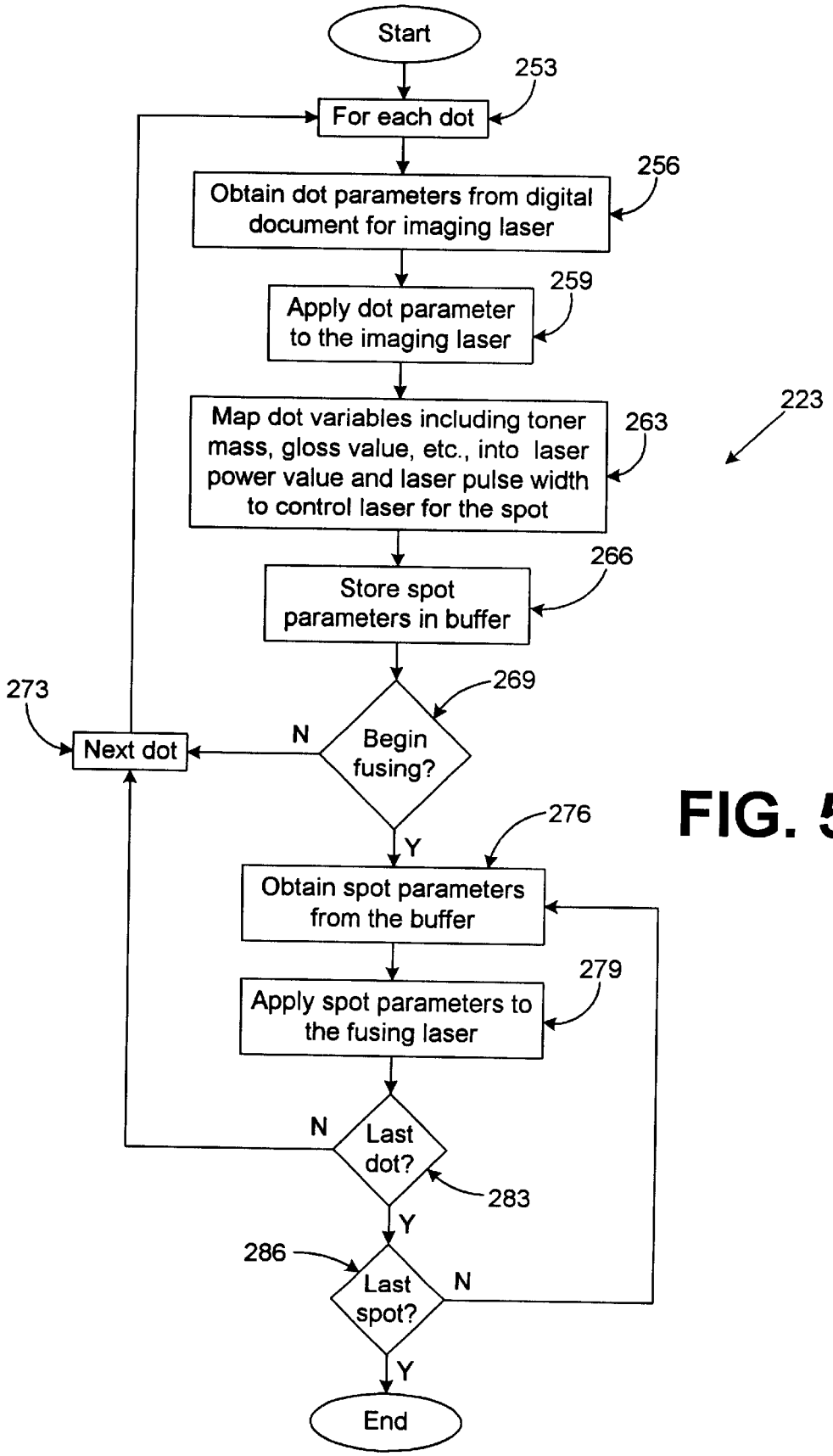
FIG. 5 is a flow chart of laser control logic executed in the laser control system of FIG. 4.

With reference to FIG. 5, shown is a flow chart of the laser control logic 223, according to another aspect of the present invention. Alternatively, the flow chart of FIG. 5 may be viewed as a method performed in the laser control 106. The laser control logic 223 is executed to drive the imaging laser 219 and the fusing laser 103 (FIG. 4) based on the digital document 226 stored in the memory 206. According to the laser control logic 223, it is assumed, for example, that the size of the spots 133 is the same as the size of the dots 136. Beginning with block 253, for a given page, a loop is defined to process the parameters associated with each dot 136 (FIG. 1) in order to identify parameters for each spot 133 (FIG. 1) that are used to control the fusing laser 103 (FIG. 1).

Next, in block 256 the parameters associated with a given dot 136 are obtained from the digital document 226 in the memory 226. The dot parameters may include, for example, the toner mass of the dot 136 and the desired gloss for the dot 136 as well as the speed that the document 126 progresses along the print medium pathway 123, etc. In block 259 the same parameters are applied to the imaging laser 219 to generate the images on the photoconductive drum. Thereafter, in block 263 the dot parameters are mapped to spot parameters including, for example, a laser power value and laser pulse width to be applied to the fusing laser 103 to melt the toner on the dot 136.

Then in block 266, the spot parameters are stored in a buffer that may be contained, for example, in the memory 206. The buffer is a "first-in-first-out" (FIFO) buffer employed to introduce a delay in the application of the spot parameters to the fusing laser 103 as the fusing laser 103 is positioned after the photoconductive drum along the print medium pathway 123. In block 269 it is determined whether the first dots 136 on a page have progressed to a point in the print medium pathway 126 (FIG. 1) accessible by the laser beam 109. If not, then the laser control logic 223 moves to block 273 where the next dot 136 is identified for processing. The laser control logic 223 then reverts back to block 253. This takes into account the fact that initially, an image is created on the photoconductive drum for some time before the print medium 126 is accessible by the laser beam 109.

On the other hand, if in block 269 the first dots 136 on a page have reached a point that can be exposed to the laser beam 109, then the laser control logic 223 proceeds to block 276 in which the appropriate spot parameters including the laser power and pulse width are obtained from the buffer. In block 279 the spot parameters are applied to the fusing laser 103 to generate the laser beam 109 that is applied to the corresponding spot 133 that lies over the respective dot 136, thereby fusing the toner deposited thereon. In block 283, it is determined whether the last dot 136 on the current page has been processed. If not, then the laser control logic 223 reverts back to block 273 to identify the next dot for processing. If the last dot 136 has been processed in block 283, then the laser control logic 223 moves to block 286 to determine whether the last spot 133 has been exposed. If not, then the laser control logic 223 reverts back to block 276 to obtain the next spot parameters accordingly. This assumes that the image has been fully developed on the photoconductive drum, but the entire image has not been fused to the print medium 126. On the other hand, if the last spot 136 has been exposed by the fusing laser 103, then the laser control logic 223 ends accordingly, to be executed for another page as needed.

Although the logic 223 (FIG. 5) of the present invention is embodied in software or firmware as discussed above, as an alternative the logic 223 may also be embodied in hardware or a combination of software and hardware. If embodied in hardware, the logic 223 can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, programmable gate arrays (PGA), field programmable gate arrays (FPGA), or other components, etc. Such technologies are generally well known by those skilled in the art and, consequently, are not described in detail herein.

The flow chart of FIG. 5 shows the architecture, functionality, and operation of an implementation of the logic 223. If embodied in software, each block may represent a module, segment, or portion of code that comprises one or more executable instructions to implement the specified logical function(s). If embodied in hardware, each block may represent a circuit or a number of interconnected circuits to implement the specified logical function(s). Although the flow chart of FIG. 5 shows a specific order of execution, it is understood that the order of execution may differ from that which is depicted. For example, the order of execution of two or more blocks may be scrambled relative to the order shown. Also, two or more blocks shown in succession in FIG. 5 may be executed concurrently or with partial concurrence. It is understood that all such variations are within the scope of the present invention.

Also, the logic 223 can be embodied in any computer-readable medium for use by or in connection with an instruction execution system such as a computer/processor based system or other system that can fetch or obtain the logic from the computer-readable medium and execute the instructions contained therein. In the context of this document, a "computer-readable medium" can be any medium that can contain, store, or maintain the logic 223 for use by or in connection with the instruction execution system. The computer readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc.

Although the invention is shown and described with respect to certain preferred embodiments, it is obvious that equivalents and modifications will occur to others skilled in the art upon the reading and understanding of the specification. The present invention includes all such equivalents and modifications, and is limited only by the scope of the claims.

What is claimed is:

1. A toner fusing apparatus, comprising:

a fusing laser generating a laser beam; and an arrangement of optical components defining a scanning optical pathway between the fusing laser and a print medium, wherein the laser beam is directed along the scanning optical pathway to fuse an amount of toner on selective ones of a number of dots on a print medium;

a laser controller selectively driving the fusing laser, thereby exposing the laser beam to selective ones of the number of dots on the print medium having the amount of toner, wherein for each of the selective ones of the dots, a power of the fusing laser is determined based upon a mass of the amount of toner thereon.

2. The toner fusing apparatus of claim 1, wherein the arrangement of optical components further comprises optical beam-shaping components.

3. The toner fusing apparatus of claim 1, wherein the arrangement of optical components further comprises optical beam reflecting components.

4. The toner fusing apparatus of claim 1, wherein the laser controller drives the fusing laser by determining a laser power and a pulse width of the laser beam.

5. A toner fusing apparatus, comprising:

a fusing laser generating a laser beam; and an arrangement of optical components defining a scanning optical pathway between the fusing laser and a print medium, wherein the laser beam is directed along the scanning optical pathway to fuse an amount of toner on selective ones of a number of dots on a print medium; and a laser controller selectively driving the fusing laser, thereby exposing the laser beam to selective ones of the number of dots on the print medium having the amount of toner, the laser controller driving the fusing laser by determining a laser power and a pulse width of the laser beam, wherein the laser controller determines the laser power and the pulse width of the laser beam based upon a desired gloss for each of the dots.

6. A toner fusing apparatus, comprising:

a fusing laser generating a laser beam;

an arrangement of optical components defining a scanning optical pathway between the fusing laser and a print medium, wherein the laser beam is directed along the scanning optical pathway to fuse an amount of toner on selective ones of a number of dots on a print medium; and a laser controller selectively driving the fusing laser, thereby exposing the laser beam to selective ones of the number of dots on the print medium having the amount of toner, the laser controller driving the fusing laser by determining a laser power and a pulse width of the laser beam, wherein the laser controller determines the laser power and the pulse width of the laser beam for each of the selective ones of the dots based upon a mass of the amount of toner in each of the dots, respectively.

7. A method for fusing toner, comprising the steps of:

generating a laser beam with a fusing laser;

providing a scanning optical pathway for the laser beam from the fusing laser to a number of dots on a print medium with an arrangement of optical components;

determining an amount of energy to be applied to an amount of toner on each of a select number of the dots to fuse the amount of toner to the print medium based upon a mass of the amount of toner; and fusing the amount of toner on the select number of the dots to the print medium with the laser beam, the laser beam transferring the amount of energy to the amount of toner.

8. The method of claim 7, wherein the step of providing the scanning optical pathway for the laser beam from the fusing laser to the number of dots on the print medium with the arrangement of optical components further comprises shaping the laser beam with optical shaping components.

9. The method of claim 7, wherein the step of providing the scanning optical pathway for the laser beam from the fusing laser to the number of dots on the print medium with the arrangement of optical components further comprises the step of reflecting the laser beam with a mirror.

10. The method of claim 7, wherein the step of fusing the amount of toner on the select number of the dots to the print medium further comprises the step of controlling a power of the laser beam and a pulse width of the laser beam.

11. A method for fusing toner, comprising the steps of:

generating a laser beam with a fusing laser;

providing a scanning optical pathway for the laser beam from the fusing laser to a number of dots on a print medium with an arrangement of optical components;

fusing an amount of toner on selective ones of the dots to the print medium with an amount of energy from the laser beam;

determining the amount of energy by controlling a power of the laser beam and a pulse width of the laser beam, wherein the power and the pulse width are determined to achieve a desired gloss for each of the dots.

12. A method for fusing toner, comprising the steps of:

generating a laser beam with a fusing laser;

providing a scanning optical pathway for the laser beam from the fusing laser to a number of dots on a print medium with an arrangement of optical components;

fusing an amount of toner on selective ones of the dots to the print medium with an amount of energy from the laser beam;

determining the amount of energy by controlling a power of the laser beam and a pulse width of the laser beam based upon a mass of the amount of toner on the selective ones of the dots.

13. An apparatus for fusing toner to a print medium, comprising:

a laser source optically coupled to a predefined position in a print medium pathway, wherein a laser beam generated by the laser source is directed to fall upon the print medium shuttled along the print medium pathway; and a laser controller coupled to the laser source to control the laser beam to generate a fusing exposure of the laser beam on the print medium, the laser controller determining an amount of energy that is transferred by the fusing exposure based upon a characteristic of an amount of toner to be fused to the print medium by the fusing exposure.

14. The apparatus of claim 13, wherein the laser source is optically coupled to the predefined position in the print medium pathway by optical components, the optical components comprising:

at least one moveable mirror; and an arrangement of beam-shaping optics to shape the laser beam.

15. The apparatus of claim 13, wherein the laser beam is focused to a predefined spot size on the print medium.

16. The apparatus of claim 15, wherein the spot size is at least as great as an area of a single dot on the print medium.

17. The apparatus of claim 15, further comprising an arrangement of beam-shaping optics to focus the laser beam.

18. An apparatus for fusing toner to a print medium, comprising:

a laser source optically coupled to a predefined position in a print medium pathway, wherein a laser beam generated by the laser source is directed to fall upon the print medium shuttled along the print medium pathway;

a laser controller coupled to the laser source to control the laser beam to generate a fusing exposure of the laser beam on the print medium, wherein the laser controller further comprises:

a processor coupled to a local interface;

a memory coupled to the local interface; and fusing logic stored on the memory and executable by the processor, the fusing logic comprising:

logic to identify the fusing exposure for a dot on the print medium; and logic to apply an output signal to the laser source to generate the fusing exposure.

19. An apparatus for fusing toner to a print medium, comprising:

a laser source optically coupled to a predefined position in a print medium pathway, wherein a laser beam generated by the laser source is directed to fall upon the print medium shuttled along the print medium pathway, the laser beam being focused to a predefined spot size on the print medium, the spot size being less than an area of a single dot on the print medium; and a laser controller coupled to the laser source to control the laser beam to generate a fusing exposure of the laser beam on the print medium.

20. An apparatus for fusing toner to a print medium, comprising:

means for generating a laser beam;

means for coupling the laser beam to a predefined position in a print medium pathway, wherein the laser beam is directed to fall upon the print medium shuttled along the print medium pathway;

means for determining an amount of energy to be transferred by a fusing exposure to be applied to the print medium based upon a characteristic of an amount of toner to be fused to the print medium by the fusing exposure; and means for controlling the laser beam to generate the fusing exposure of the laser beam on the print medium.

21. The apparatus of claim 20, wherein the means for coupling the laser beam to a predefined position in print medium pathway further comprises:

at least one moveable mirror; and beam-shaping optics to shape the laser beam.

22. The apparatus of claim 20, wherein the means for coupling the laser beam to a predefined position in a print medium pathway further comprises means for focusing the laser beam to a predefined spot size on the print medium.

23. The apparatus of claim 22, wherein the spot size is at least as great as an area of a single dot on the print medium.

24. The apparatus of claim 22, wherein the spot size is less than an area of a single dot on the print medium.

25. The apparatus of claim 22, further comprising beam-shaping optics to focus the laser beam.

26. A method for fusing toner to a print medium, comprising the steps of:

generating a laser beam;

coupling the laser beam to a predefined position in a print medium pathway, wherein the laser beam is directed to fall upon the print medium shuttled along the print medium pathway;

determining an amount of energy to transfer to an amount of toner in a fusing exposure to fuse the amount of toner to the print medium based upon a characteristic of the amount of toner, the amount of toner being located at the predefined position; and controlling the laser beam to generate the fusing exposure at the predefined position to fuse the amount of toner to the print medium.

27. The method of claim 26, wherein the step of coupling the laser beam to a predefined position in a print medium pathway further comprises the steps of:

positioning at least one moveable mirror; and positioning a number of beam-shaping optical components to shape the laser beam.

28. The method of claim 26, wherein the step of coupling a laser beam to a predefined position in a print medium pathway further comprises the step of focusing the laser beam to a predefined spot size on the print medium.

29. The method of claim 28, wherein the step of focusing the laser beam to a predefined spot size on the print medium further comprises the step of focusing the laser beam to a spot size that is at least as great as an area of a single dot on the print medium.

30. The method of claim 28, wherein the step of focusing the laser beam to a predefined spot size on the print medium further comprises the step of focusing the laser beam to a spot size that is less than an area of a single dot on the print medium.

31. A toner fusing apparatus, comprising:

at least one fusing laser generating a laser beam;

an arrangement of optical components defining a scanning optical pathway between the at least one fusing laser and a print medium, wherein an amount of toner is located at each one of a number of dots on the print medium; and a laser controller that drives the at least one fusing laser to generate a fusing exposure upon each one of a number of spots on the print medium, wherein an area of each of the spots coincides with an area of at least a portion of one of the dots, and, at least a portion of the amount of toner located on each one of the number of dots falls within the area of a respective one of the spots, and, the laser controller determining an amount of energy of each of the fusing exposures applied to respective ones of the spots based upon a characteristic of the at least a portion of the amount of toner that is located within the area of the respective one of the spots.

32. The toner fusing apparatus of claim 31, wherein the characteristic of the at least a portion of the amount of toner that is located within the area of the respective one of the spots further comprises a mass of the at least a portion of the amount of toner that is located within the area of the respective one of the spots.

33. The toner fusing apparatus of claim 31, wherein the characteristic of the at least a portion of the amount of toner that is located within the area of the respective one of the spots further comprises a chemical makeup of the at least a portion of the amount of toner that is located within the area of the respective one of the spots.

34. The toner fusing apparatus of claim 31, wherein the characteristic of the at least a portion of the amount of toner that is located within the area of the respective one of the spots further comprises a color of the at least a portion of the amount of toner that is located within the area of the respective one of the spots.

35. The toner fusing apparatus of claim 31, wherein the at least one fusing laser generates the laser beam having at least one wavelength that is readily absorbed by the at least a portion of the amount of toner that is located within the area of the respective one of the spots.

36. The toner fusing apparatus of claim 31, wherein the laser controller controls a power of the laser beam in driving the at least one fusing laser to generate each of the fusing exposures.

37. The toner fusing apparatus of claim 31, wherein the laser controller controls a pulse width of the laser beam in driving the at least one fusing laser to generate each of the fusing exposures.

38. The toner fusing apparatus of claim 31, wherein the area of each of the spots is less than the area of each of the dots.

39. The toner fusing apparatus of claim 31, wherein the area of each of the spots is greater than the area of each of the dots.

40. The toner fusing apparatus of claim 31, wherein the area of each of the spots is equal to the area of each of the dots.

41. The toner fusing apparatus of claim 31, wherein the laser controller further drives the at least one fusing laser to generate a number of fusing exposures upon each one of a number of spots on the print medium.

42. A toner fusing method, comprising:

generating a laser beam with at least one fusing laser;

directing the laser beam toward a number of spots on a print medium, wherein an amount of toner is located on the print medium in an area coinciding with each of the spots; and controlling the fusing laser so as to generate a fusing exposure on each of the spots on the print medium, wherein an amount of energy transferred in each of the fusing exposures depends upon a characteristic of the amount of toner located within each of the spots, respectively.

43. The toner fusing method of claim 42, further comprising controlling the fusing laser to generate the fusing exposure based upon a mass of the amount of toner.

44. The toner fusing method of claim 42, further comprising controlling the fusing laser to generate the fusing exposure based upon a chemical makeup of the amount of toner.

45. The toner fusing method of claim 42, further comprising controlling the fusing laser to generate the fusing exposure based upon a color of the amount of toner.

46. The toner fusing method of claim 42, further comprising controlling a power of the laser beam generated by the at least one fusing laser.

47. The toner fusing method of claim 42, further comprising controlling a pulse width of the laser beam generated by the at least one fusing laser.

* * * * *